US005800041A

United States Patent [19]

Poggi

[11] Patent Number: 5,800,041

[45] Date of Patent: Sep. 1, 1998

[54] UNDERWATER LIGHT FITTING

[75] Inventor: Bryan Poggi, Hamilton, United Kingdom

[73] Assignee: Aqua Pharos International Limited, Hamilton, United Kingdom

[21] Appl. No.: 737,969

[22] PCT Filed: May 20, 1995

[86] PCT No.: PCT/GB95/01159

§ 371 Date: Nov. 22, 1996

§ 102(e) Date: Nov. 22, 1996

[87] PCT Pub. No.: WO95/32288

PCT Pub. Date: Nov. 30, 1995

[30] Foreign Application Priority Data

May 24, 1994 [GB] United Kingdom ..... 9410401

[51] Int. Cl.[6] ..... F21V 31/02

[52] U.S. Cl. ..... 362/101; 362/267; 362/364

[58] Field of Search ..... 362/96, 101, 145, 362/147, 158, 267, 364, 365

[56] References Cited

U.S. PATENT DOCUMENTS

| | | | |
|---|---|---|---|
| 1,806,435 | 5/1931 | Werner | 362/267 |
| 1,968,072 | 7/1934 | Creighton | 362/101 |
| 4,156,894 | 5/1979 | Berry . | |
| 4,290,094 | 9/1981 | Jensen . | |
| 4,539,629 | 9/1985 | Poppenheimer | 362/267 |
| 4,574,337 | 3/1986 | Poppenheimer . | |
| 4,996,635 | 2/1991 | Olsson . | |
| 5,045,978 | 9/1991 | Gargle | 362/101 |
| 5,128,845 | 7/1992 | Hoffmeier . | |

FOREIGN PATENT DOCUMENTS

| | | | |
|---|---|---|---|
| 763 047 | 4/1934 | France . | |
| 2021749 | 12/1979 | United Kingdom | 362/267 |
| 2 178 603 | 2/1987 | United Kingdom . | |
| 2 247 943 | 3/1992 | United Kingdom . | |

*Primary Examiner*—Y My Quach
*Attorney, Agent, or Firm*—Reid & Priest LLP

[57] ABSTRACT

An underwater light fitting suitable for niche mounting in swimming pools comprises a housing including a casing, a light transmissive portion in the form of a lens, and a removable portion. Inside the housing there is a bulb mounted on a connection member. The removable portion may be removed from the casing to allow easy access to, and thus facilitate replacement of, the bulb, without necessitating removal of the lens. A seal, preferably in the form of a resilient reusable O-ring, may be provided between the removable portion and the casing. In use, the light fitting is connected to a power source by a power transmission cable, and a wet-mateable connection is provided in the cable, enabling the whole housing to be removed to any convenient location for maintenance. The light fitting may include a reflector which may be adjustable so as to allow control over the direction of light emitted from the fitting.

20 Claims, 4 Drawing Sheets

UNDERWATER LIGHT FITTING

BACKGROUND OF THE INVENTION

1. Field of the Invention

This invention relates to an underwater light fitting and particularly, but not exclusively, to an underwater light fitting for use in swimming pools and spa baths, hereafter referred to as "pools".

2. Description of the Prior Art

Underwater light fittings are often installed in pools and there are two basic designs of fitting. A first known design uses a modular unit which includes a bulb in a cavity enclosed by a permanently sealed body. The body includes a transparent or translucent face at its front so that illumination from the bulb may project into the pool. The body may also include a reflector in order to project additional illumination from the bulb through the face into the pool. When a bulb in such a unit needs to be replaced the entire modular unit is replaced.

A second design uses a separately replaceable bulb in a housing having a watertight seal between a casing at the rear of the housing and a plain glass face at the front of the housing. In pools the light housing, in use, is installed in a niche. Power is generally supplied via an insulated cable which emerges from some part of the niche wall and enters the housing via an aperture. The aperture includes a permanent seal, in order to prevent water from entering the housing. In use, the housing is cooled by water circulating in the space between the rear wall of the niche and the housing (and also, of course, by water in contact with the plain glass face at the front of the housing). Holes may be provided in order to allow water to enter the niche, enhancing the cooling effect. When it is necessary to replace the bulb or perform other maintenance the housing is demounted from the niche and lifted out of the water. The length of cable between the niche wall and the housing is generally about 1.5 yards (1.5 m), this being sufficiently long to allow the housing to be lifted out of the water but sufficiently short to enable the cable to fit comfortably in the niche cavity behind the housing when the housing is mounted in the niche.

Clearly the light housing cannot be moved further away from the niche than the length of the cable permits without being disconnected from the cable. For this reason, work that must be performed, such as replacement of the bulb or other maintenance, is generally performed at the poolside. This is not necessarily a convenient place to perform such operations.

The known light fittings also suffer from other problems in use. The fittings incorporating modular units are expensive to maintain since when a bulb needs to be replaced the rest of the modular unit is also replaced. The bulbs in such units tend to have a relatively short lifetime (of the order of 250 hours of use) and such frequent replacement may be prohibitively expensive.

The units having separately replaceable bulbs are less expensive to maintain. However, in order to replace the bulb the waterproof housing must be dismantled, normally by removal of the face from the rest of the housing. After replacement of the bulb, the housing must be reassembled ensuring that all seals are intact and in place so that the waterproof integrity of the housing is maintained.

Dismantling the housing may be difficult, since the fastenings are generally of metal and may be considerably corroded after spending a long period of time submerged in, for example, chlorinated water.

Once the housing is dismantled it may be found that the seals from between the face and the rest of the housing need to be replaced because that they have warped, perished or deformed so that they cannot be effectively reused. These seals are generally annular having a diameter of several inches (of the order of 20 cm), and are therefore particularly susceptible to such wear.

Another disadvantage of using known fittings of the type having replaceable bulbs is that wires inside the light housing may become brittle due to the build up of heat in the housing during use, and may break during maintenance or bulb replacement. This necessitates drawing some of the cable attaching the light housing to the niche, into the housing in order to replace the damaged cable. Each time a length of cable is drawn into the housing for this reason, the remaining length of cable decreases and eventually there is insufficient cable left to allow the housing to be removed from the water. At this point replacement of the entire length of cable becomes necessary. This requires lowering the level of water in the pool below the level of the niche and considerable rewiring.

After bulb replacement the housing must be reassembled and it is vital to ensure that it is waterproof. There is therefore a tendency to over-tighten fixings in order to ensure a secure seal between the glass face and the rest of the housing, and this may damage the fixings, making subsequent bulb replacement still more difficult.

SUMMARY OF THE INVENTION

According to the present invention there is provided an underwater light fitting comprising:

a housing, comprising a waterproof casing, a light transmissive portion and an entry means for a power transmission means to enter said housing, said entry means providing a watertight seal;

mounting means for releasably mounting said housing into a niche provided in a wall or other surface;

power transmission means adapted to lead from a power source to a light source within said housing;

a wet-mateable connection in the power transmission means;

and wherein the waterproof casing includes a removable portion, which may be replaceably removed from the remainder of the casing, allowing removal of the light source from the housing.

Preferably, a seal is provided in order to prevent ingress of water to the housing through the interface between the removable portion of the casing and the remainder of the casing.

Preferably, said seal is an "O" ring.

Preferably, the removable portion of the casing comprises a cap having a generally cylindrical portion with a screw thread, configured to engage a portion of the remainder of the casing having a complementary thread.

Preferably, there is provided a connection member which, in use, is coupled to the light source located inside the housing and a portion of which extends between some part of the removable portion of the casing and some part of the remainder of the casing.

Preferably, the seal is located between the connection member and the casing and said seal may be compressed by the action of screwing the cap onto the remainder of the casing.

Preferably, the power transmission means is an electric cable.

Preferably, a substantial part of the waterproof casing is made from a plastics material.

Preferably, said substantial part of the waterproof casing is produced by an injection moulding process.

Preferably, the housing is of a size and configuration such that the niche in which it is mounted can accommodate a volume of water in addition to the housing.

Preferably, there is provided means to allow water to enter the niche when the housing is mounted in the niche.

Preferably, there is provided reflection means, intermediate the light souce and at least some portion of the casing, and said reflection means is adjustable in order to adjust the reflection characteristics thereof.

Preferably, the light transmissive portion of the housing comprises a converging or diverging lens, which may be a Fresnel lens.

BRIEF DESCRIPTION OF THE DRAWING

Embodiments of the present invention will now be described, by way of example, with reference to the accompanying drawings in which.

DESCRIPTION OF THE PREFERRED EMBODIMENTS

Figure 1:
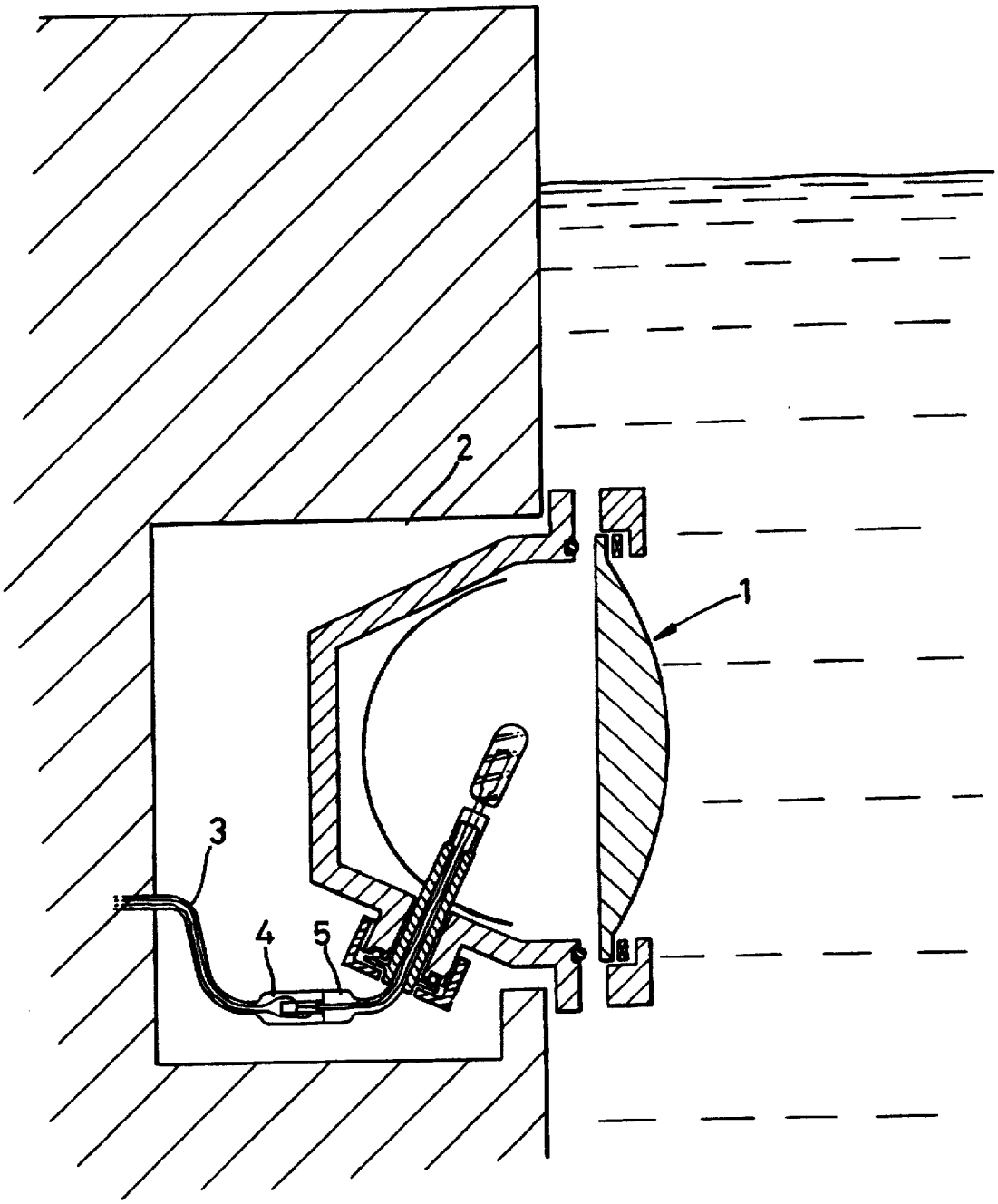
FIG. 1 is a schematic sectional view of an underwater light fitting according to the present invention, mounted in a niche.

With reference to FIG. 1, an underwater light fitting comprises a housing generally designated 1, mounted in a niche 2 in the side wall of a pool, and a power transmission cable 3 running from a wall of the niche 2 to the housing 1. The power transmission cable 3 is provided with a wet-mateable connection 4, 5 between the wall of the niche 2 and the housing 1.

Wet-mateable connections, alternatively called underwater mateable connections, are known devices, often used in electrical cables when it is desirable to make and/or break connections underwater. Such connections typically comprise at least one pair of terminals to be connected, one of the pair being provided on a pin and the other being provided in a socket. Insertion of the pin into the socket makes the connection by bringing the pair of terminals into contact with each other. The close fit of the pin in the socket expels water from the vicinity of the terminals. Such a connection can therefore be operated underwater, which in many circumstances is more convenient than making the connection in a dry environment, sealing it, and then moving it to the required, immersed location. Typically, such connections require the power to be disconnected while the pin is not inserted in the socket, since when this is the case, the terminals will not be isolated from the surrounding water.

The housing 1 is shown in a slightly exploded manner in order that the individual elements may easily be seen.

Figure 2:
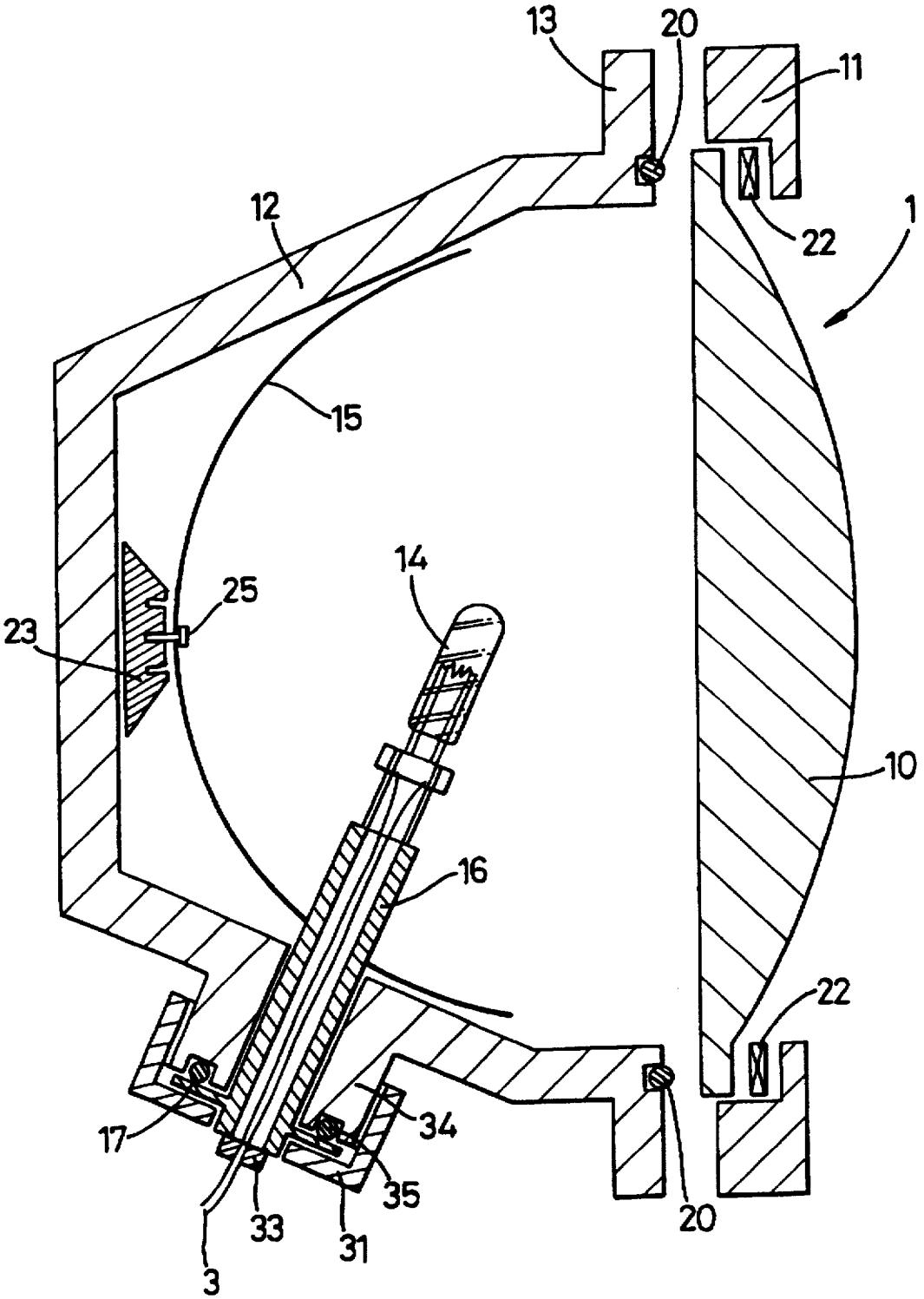
FIG. 2 shows a sectional view of the housing of the light fitting of FIG. 1.

Referring to FIG. 2 the housing 1 comprises a lens 10 at the front of the housing 1 which is attached, by means of a bezel 11, to a casing 12 which constitutes the rear and sides of the housing 1. Use of a selected lens 10 rather than a plain glass face allows the degree of dispersion of illumination into the water to be selectively predetermined (although a plain glass face could be used). A seal, preferably a recessed "O" ring 20, is provided in order to make the join between the lens 10 and the casing 12 water-tight and an additional seal 22 is provided between the bezel 11 and the lens 10. The casing 12 provides a flange 13 to which the bezel 11 is attached via known fixings such as nut and bolt assemblies (not shown). Once the lens 10 is attached by the bezel 11 to the casing 12 it remains in position, and although it may be removed in order to perform maintenance operations it need not be removed for routine bulb replacement. Standard fixings are therefore adequate even though their use might cause problems in a housing where they would be loosened and retightened each time a bulb needed to be replaced.

As shown in FIG. 1, when the housing 1 is mounted in the niche 2, the flange 13 abuts the edges of the niche. As will be further noted from FIG. 1, no seal is provided between the flange 13 and the edges of the niche. Because no seal is provided between the flange 13 and the edges of the niche, water is allowed to enter the niche when the housing 1 is mounted in the niche.

The housing 1 contains a light source in the form of a bulb 14 to provide illumination and a (preferably diffusing) reflector 15, mounted on a reflector mounting block 23, to reflect illumination from the bulb 14 towards the lens 10 at the front of the housing 1. It is desirable to use a reflector and/or reflector mounting which can be arranged in one of several configurations. This allows the characteristics of the light projected from the housing to be selected according to, for example, the height above the pool bottom at which the light fitting is to be installed.

Figure 5:
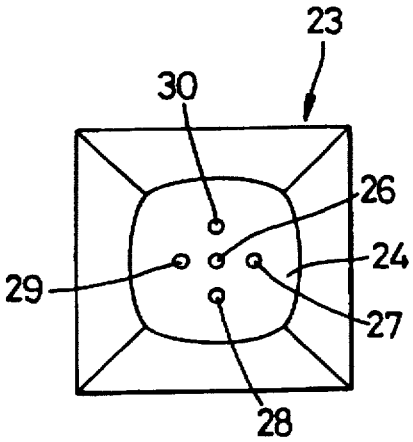
FIG. 5 shows a plan view of a reflector mounting block used in the embodiment of FIG. 2.

The reflector 15 is attached to the reflector mounting block 23 (which is shown in FIG. 5) by attachment means in the form of a screw 25 which passes through an aperture (not shown) in the reflector 15 and into one of a number of holes 26, 27, 28, 29, 30 provided in the mounting block 23. The part of the reflector 15 adjacent the screw 25 is thereby held in contact with a concave surface 24 of the mounting block 23. The holes 26, 27, 28, 29, 30 provided in the mounting block 23 are distributed so that the orientation of the reflector 15 relative to the casing 12 may be selected by selection of the hole via which the reflector 15 is attached to the mounting block 23.

The bulb 14 is mounted on a connection assembly 16, and the bulb 14 and connection assembly 16 may be removed from the housing 1 (as will be described hereafter) in order to change the bulb.

Figure 3:
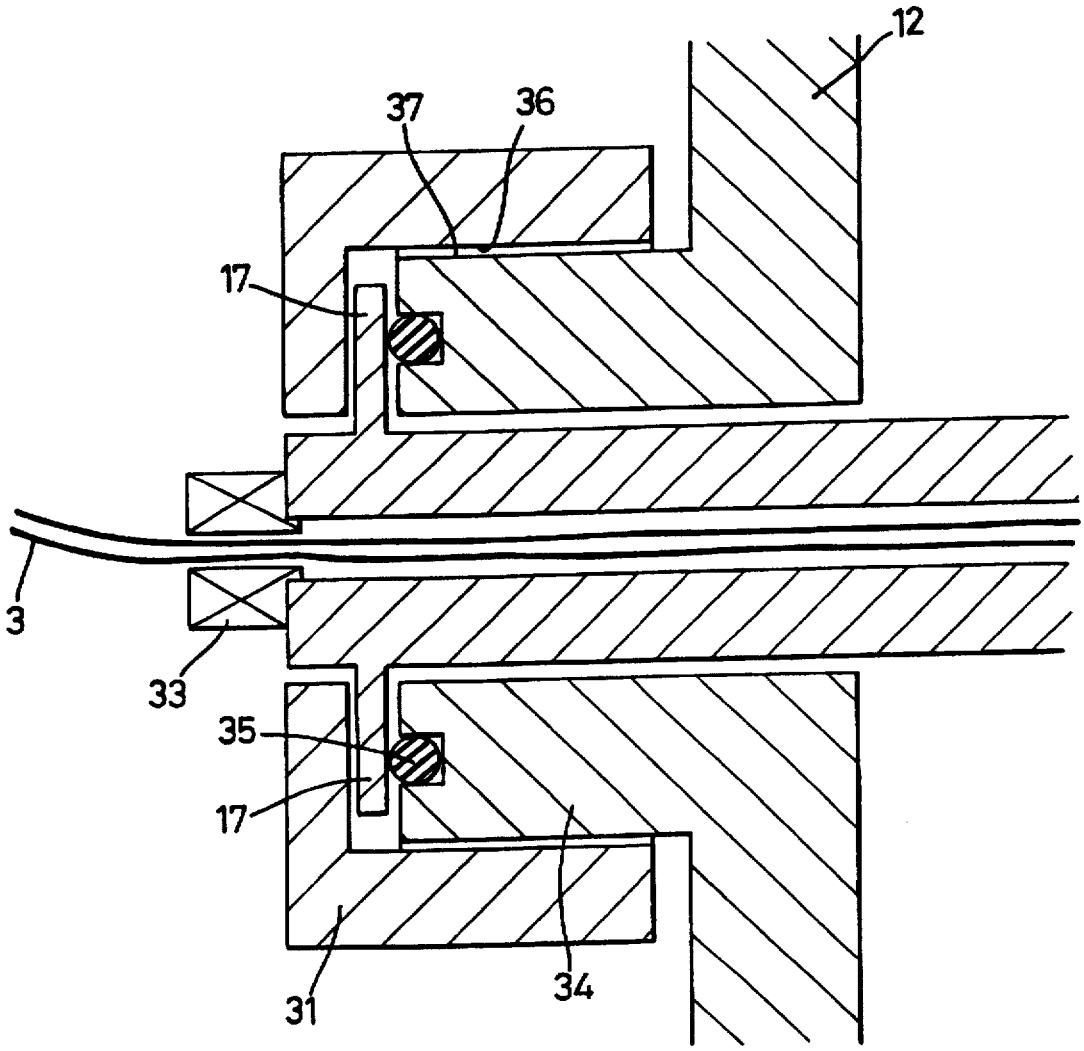
FIG. 3 shows a detail of the housing of FIG. 2.

FIG. 3 shows a detail of the casing 12 of the housing 1 and also shows the connection assembly 16 in detail. The connection assembly 16 is generally cylindrical and includes a central cylindrical bore through which a power transmission cable 3 passes from the exterior of the housing 1 to the interior, supplying power to the bulb 14. Where the cable 3 enters the connection assembly 16 at the outside of the housing 1, a permanent seal 33 is provided in order to prevent the ingress of water in which the housing 1 will, in use, be immersed. The seal 33 may be a potting material or gland or may comprise a waterproof sleeve or gaiter enclosing the interface between the cable 3 and the connector assembly 16.

The connection assembly 16 passes through a cylindrical bore defined by a shaped portion 34 of the casing 12. The generally cylindrical connection assembly 16 includes a flange 17 which, in use, is seated across the external end of the shaped portion 34 of the casing 12.

A cap 31 is provided which secures the flange 17 of the connection assembly 16 to the shaped portion 34 of the casing 12. The cap 31 has an internally threaded portion 36 which engages an externally threaded portion 37 of the shaped portion 34 of the casing 12. The cap 31 thus screws onto the shaped portion 34, securing the flange 17 of the connection assembly 16 to the external end of the shaped portion 34 of the casing 12. An "O" ring 35 is provided between the flange 17 and the external end of the shaped portion 34, in order to prevent ingress of water. In use, therefore, the housing 1 is water-tight.

In order to change a bulb 14, the housing 1 is removed from the water in which it is, in use, immersed. In order to remove the housing from the water, the housing 1 is removed from the mountings (not shown) holding it in the niche 2. At this point it is still attached to the wall of the niche 2 by the power transmission cable 3. However, the housing 1 can be pulled a small distance out of the niche 2 and can then be detached from the rear wall of the niche 2 by separating the two elements 4, 5 of the wet-mateable connector which is provided in the power transmission cable 3. The housing 1 is thus completely freed of its connection to the niche 2 and may be removed not only from the water but also from the vicinity of the pool in which it was installed. The cap 31 is then unscrewed and removed from the shaped portion 34 of the casing 12. This releases the connection assembly 16 which is then withdrawn from the housing 1 along with the attached bulb 14. The bulb 14 may then be replaced (that is a new bulb may be connected to the connection assembly 16) and the new bulb 14 and the connection assembly 16 then inserted into the housing 1. The cap 31 is then screwed down onto the shaped portion 34 of the casing 12, securing the connection assembly 16 in place.

The cap 31 is designed to be operable by hand, and using a suitable pitch of thread enables a large force to be applied to the sealed interface between the flange 17 of the connection assembly 16 and the external end of the shaped portion 34, of the casing 12. This force deforms the "O" ring provided between the flange 17 and the shaped portion 34 of the casing 12, forming a good seal.

The "O" ring is recessed into the end of the shaped portion 34 of the casing 12. Such "O" rings are quite resilient and can be used many times without a significant reduction the efficiency of the seals formed. This resilience is due, in part, to the dimensions of the "O" ring. The diameter of an "O" ring suitable for use in the housing described might be between about one inch (2.5 cm) and two inches (5 cm), whilst the thickness (that is the diameter of the rubber element forming the ring) might be between about 0.2 inches (0.5 cm) to 0.3 inches (0.75 cm). In contrast a seal used between the casing and the glass face of a previously known housing might have a diameter of the order of 8 inches (20 cm) and a thickness of about 0.05 inches (0.1 cm). Such seals are much more prone to perish or warp than the relatively compact "O" ring. Should the "O" ring 35 need to be replaced, the operation would consist of simply dropping a new "O" ring into the recess, covering it with the flange 17 by inserting the connection assembly 16 into the bore formed by the shaped portion 34 of the casing 12, and screwing down the cap 31. The relatively small diameter of the "O" ring and the provision of a recess, help to make this operation much easier and quicker to perform than the seating of a seal between the casing and the lens.

Figure 4:
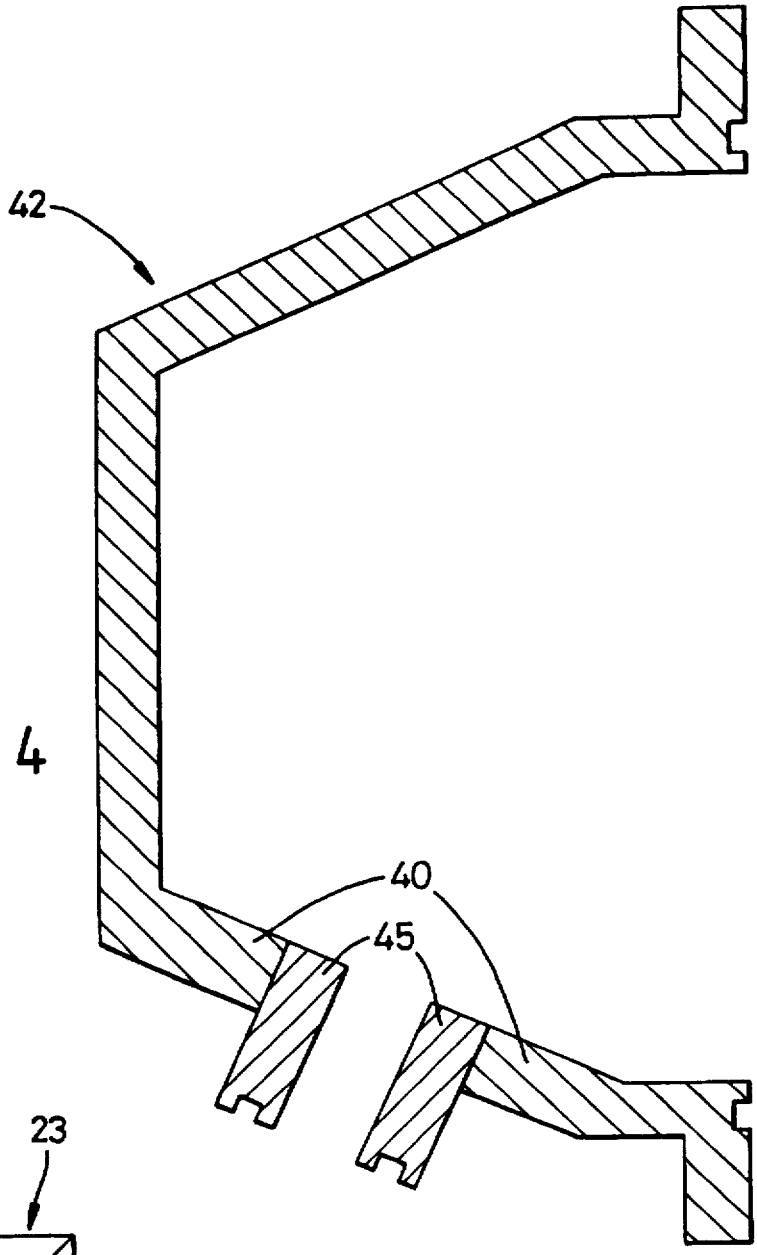
FIG. 4 shows a cross sectional view of part of a light housing suitable for production by plastics injection moulding.

FIG. 4 shows a cross section of part of an alternatively constructed casing 42, showing an appropriate shape and configuration for manufacture from a plastics material by an injection moulding process. The main part 40 of the casing 42 is manufactured by injection moulding, being so configured that moulding tools can form the required shape and then be withdrawn. That is, the shape of the casing 42 as shown in FIG. 4 is such that each part of the surface of the main part 40 is exposed either to the left or to the right and no part is obstructed by another part of the main part 40.

The additional part of the casing 45, which constitutes the shaped portion which, in use, houses the connection assembly 16 and to which the cap 31 attaches, can be manufactured separately out of a suitable material, and then attached to the main part 40 of the casing 42.

The embodiments described above have many advantages over previously known underwater light fittings.

The wet-mateable connection 4,5 in the cable 3 enables the housing 1 to be easily disconnected from the niche 2. This means that maintenance may be performed in any convenient location, rather than being limited to the poolside. In addition the length of cable 3 needed is much smaller (since it need not reach from the niche 2 to the poolside) than in previous fittings. This allows greater circulation of water in the niche 2, enhancing the cooling of the housing 1. This prolongs the life of components in the housing 1, such as the cable 3 and the bulb 14, and may allow less specialised, cheaper bulbs to be used.

Removing and replacing the bulb 14 via the relatively small opening created by removal of the cap 31, rather than via the large opening created by removal of the lens 10 from the front of the housing 1, means that only this small opening need be regularly unsealed and resealed. This avoids the difficult removal of the front lens 10, and consequent disturbance of, or damage to, the more easily damaged seals around the lens. Damage to fixings resulting from regular refastening and possible over-tightening of the bezel is avoided, and the use of expensive modular units to overcome these problems is rendered unnecessary.

The use of a screw cap 31 also means that replacement of the bulb 14 may be executed without the use of tools to gain access to the interior of the housing 1. The mountings provided to mount the housing 1 into the niche 2 may, however, be of the type that can only be operated using tools, in order to reduce the chance of unauthorised persons demounting the housing.

In addition the whole housing may be replaced by merely connecting a new housing to the cable 3 in the wall of the niche 2 via the wet-mateable connector 4,5 and mounting the new housing in the niche 2. The cable between the niche wall and the wet-mateable connector is not damaged by normal operation of the light fitting and therefore does not need to be routinely replaced. This avoids the need for the expensive and time consuming operation of draining the pool.

Underwater light fittings according to the present invention may be suitable for many uses in addition to swimming pool and spa bath use. For example, such fittings may be used in beer vats or in the hulls of boats or in many other circumstances where niche mounted underwater light fittings are required.

Many alternative embodiments can be envisaged, without departing from the scope of the invention, which is indicated by the appended claims rather than by the foregoing decsription. For example, the combination of bezel 11, seal 22 and lens 10 could be replaced by a modular unit of a suitable material (such as, for example, heat resistant polycarbonate). Such a modular unit could include a light transmissive portion, corresponding in use to the lens of the illustrated embodiment, surrounded by a frosted or coloured portion, corresponding in use to the bezel of the illustrated embodiment. Use of such a modular unit would further simplify assembly and maintenance of the light fitting. The reflector mounting block, shown as having the shape of a truncated pyramid, could alternatively be of cylindrical or frustoconical shape, and could be made from a thermally conductive material in order to provide a heat sink. Alternatively, or in addition, the reflector configuration could be altered by selectively orientating flaps or panels provided on the reflective surface of the reflector.

I claim:

1. An underwater light fitting for mounting in a niche provided in a surface such as a wall, said underwater light fitting comprising:

a waterproof housing, having a front;

mounting means for releasably mounting said housing into a niche provided in a surface such as a wall;

power transmission means for transmitting power from a power source external of said housing to a light source within said housing;

a wet-mateable connection in the power transmission means;

and wherein the waterproof housing includes a casing, a light transmissive portion, entry means provided in the casing providing entry of said power transmission means into said housing, and a removable portion for sealing said entry means to prevent ingress of water into the housing, wherein said removable portion includes means to receive the power transmission means therethrough and may be replaceably removed from the housing, allowing removal of the light source from the housing via the entry means when the removable portion is removed from the entry means.

2. An underwater light fitting as claimed in claim 1, wherein there is an interface between the removable portion and the entry means, and wherein a seal is provided in order to prevent ingress of water to the housing through the interface.

3. An underwater light fitting as claimed in claim 2, wherein said seal is an "O" ring.

4. An underwater light fitting as claimed in claim 1, wherein the removable portion comprises a cap having a generally cylindrical portion with an internal screw thread, and said entry means has a complementary external thread, said screw thread of said cap being configured to engage said complementary thread of said entry means.

5. An underwater light fitting as claimed in claim 4, further comprising a connection member which, in use, is coupled to the light source located inside the housing and a portion of which extends between some part of the removable portion and some part of the casing.

6. An underwater light fitting as claimed in claim 5, wherein a seal is located between the connection member and the casing and said seal may be compressed by the action of screwing the cap onto the entry means of the casing.

7. An underwater light fitting as claimed in claim 4, wherein said means to receive the power transmission means therethrough comprises a connection member which is permanently sealed to said power transmission means, said connection member being, in use, coupled to the light source, and which, in use, extends into the entry means of the casing, is sealed against said entry means, and is retained in said entry means by said cap.

8. An underwater light fitting as claimed in claim 1, wherein the power transmission means is an electric cable.

9. An underwater light fitting as claimed in claim 1, wherein a substantial part of the casing is made from a plastic material.

10. An underwater light fitting as claimed in claim 9, wherein said substantial part of the casing is produced by an injection moulding process.

11. An underwater light fitting as claimed in claim 1, wherein the housing is of a size and configuration such that the niche in which it is mounted can accommodate a volume of water in addition to the housing.

12. An underwater light fitting as claimed in claim 11, wherein there is provided means to allow water to enter the niche when the housing is mounted in the niche.

13. An underwater light fitting as claimed in claim 1, wherein there is provided reflection means for reflecting light from the light source in said housing toward the front of said housing, wherein said reflection means is positioned intermediate the light source and at least some portion of the casing, and wherein said reflection means has reflection characteristics and is adjustable in order to adjust the reflection characteristics thereof.

14. An underwater light fitting as claimed in claim 1, wherein the light transmissive portion of the housing comprises a converging lens.

15. An underwater light fitting as claimed in claim 14, wherein the light transmissive portion of the housing comprises a Fresnel lens.

16. An underwater light fitting as claimed in claim 1, wherein the light transmissive portion of the housing comprises a diverging lens.

17. An underwater light fitting as claimed in claim 16, wherein the light transmissive portion of the housing comprises a Fresnel lens.

18. An underwater light fitting for mounting in a niche provided in a surface such as a wall, said underwater light fitting comprising:

a waterproof housing having a front;

mounting means for releasably mounting said housing into a niche provided in a surface such as a wall;

light source within said housing;

power transmission means for transmitting power from a power source external of said housing to a light source within said housing;

a wet-mateable connection in the power transmission means;

and wherein the waterproof housing includes a casing, a light transmissive portion, entry means provided in the casing providing entry of said power transmission means into said housing, and a removable portion for sealing said entry means to prevent ingress of water into the housing, wherein said removable portion includes means to receive the power transmission means therethrough and may be replaceably removed from the housing, and wherein the light source and the entry means are configured so that the light source is removable from the housing via the entry means when the removable portion is removed from the entry means.

19. An underwater light fitting as claimed in claim 18, wherein the removable portion comprises a cap having a generally cylindrical portion with an internal screw thread, and said entry means has a complementary external thread, said screw thread of said cap being configured to engage said complementary thread of said entry means.

20. An underwater light fitting as claimed in claim 19, wherein said means to receive the power transmission means therethrough comprises a connection member which is permanently sealed to said power transmission means, said connection member being, in use, coupled to the light source, and which, in use, extends into the entry means of the casing, is sealed against said entry means, and is retained in said entry means by said cap.

* * * * *